US009308403B2

(12) United States Patent
Strawder

(10) Patent No.: US 9,308,403 B2
(45) Date of Patent: Apr. 12, 2016

(54) ROOF SAFETY DEVICE

(71) Applicant: Brian K. Strawder, Carrollton, OH (US)

(72) Inventor: Brian K. Strawder, Carrollton, OH (US)

(73) Assignee: Brian K. Strawder, Carrollton, OH (US)

( * ) Notice: Subject to any disclaimer, the term of this patent is extended or adjusted under 35 U.S.C. 154(b) by 0 days.

(21) Appl. No.: 14/535,871

(22) Filed: Nov. 7, 2014

(65) Prior Publication Data

US 2015/0129356 A1 May 14, 2015

Related U.S. Application Data

(60) Provisional application No. 61/902,965, filed on Nov. 12, 2013.

(51) Int. Cl.

| | |
|---|---|
| ***E04G 3/26*** | (2006.01) |
| ***A62B 35/00*** | (2006.01) |
| ***E04G 21/32*** | (2006.01) |
| ***E04D 13/00*** | (2006.01) |
| ***E06C 7/48*** | (2006.01) |

(52) U.S. Cl.

CPC ..... *A62B 35/0068* (2013.01); *E04D 13/00* (2013.01); *E04G 3/26* (2013.01); *E04G 21/328* (2013.01); *E06C 7/488* (2013.01); *E04G 3/265* (2013.01)

(58) Field of Classification Search

CPC ..... E04G 3/26

See application file for complete search history.

(56) References Cited

U.S. PATENT DOCUMENTS

| | | | | |
|---|---|---|---|---|
| 1,495,868 | A * | 5/1924 | Nielsen | 248/237 |
| 3,727,724 | A * | 4/1973 | Gilbert et al. | 182/198 |
| 6,003,629 | A * | 12/1999 | Cloutier et al. | 182/45 |
| 7,168,523 | B1 * | 1/2007 | Tafoya et al. | 182/150 |
| 2002/0153200 | A1 * | 10/2002 | Bryant | 182/45 |
| 2014/0008150 | A1 * | 1/2014 | Baglin | 182/129 |

FOREIGN PATENT DOCUMENTS

| | | | |
|---|---|---|---|
| DE | 3317420 | A1 * | 11/1984 |
| DE | 3445682 | A1 * | 6/1986 |
| DE | 19649327 | A1 * | 6/1998 |
| DE | 19911388 | A1 * | 10/2000 |
| FR | 1332079 | A * | 12/1963 |
| FR | 2605354 | A2 * | 4/1988 |

* cited by examiner

*Primary Examiner* — Alvin Chin-Shue

(74) *Attorney, Agent, or Firm* — Dureska, Kennedy & Moore, L.L.C.; Brent L. Moore

(57) ABSTRACT

A roof safety device includes a fixed arm having a generally arched portion and a first cross-beam, a hook-slide slidably cooperating with the arched portion of the fixed arm. The hook-slide also includes a second cross-beam. The roof safety device includes a means for removably locking the hook-slide into fixed engagement with the fixed arm. A harness is connected to the fixed arm and worn by a user of the roof safety device.

10 Claims, 5 Drawing Sheets

ROOF SAFETY DEVICE

CROSS-REFERENCE TO RELATED APPLICATION

This application claims the benefit of U.S. Provisional Patent Application Ser. No. 61/902,965, filed Nov. 12, 2013.

BACKGROUND OF THE INVENTION

1. Field of the Invention

The invention relates to a safety device associated with the roofing industry. More particularly, the invention relates to a safety device that minimizes the potential for injury related to falling off of a roof surface. More specifically, the invention relates to a roof safety device that anchors to the surface of a medium-to-high pitch roof of a structure about the apex and/or roof vent of the roof to minimize potential injury to workers by preventing falls while mounting or dismounting a ladder.

2. Background Art

The roof of a structure is integral in protecting both the structure and also the occupants beneath and/or within the structure from environmental elements. In order to maintain the roof of a structure, the owner and/or workers must frequently climb atop the roof utilizing a ladder, or other climbing means, such as scaffolding. Such work may include, but is not limited to, inspections, cleaning of gutters, clearing drain pipes, and/or hanging festive lights. In order to accomplish these tasks, the workers may be required to climb atop the roof and, further, move around on the surface of the roof to accomplish the various tasks.

Maneuvering from the ladder to the roof or from the roof to the ladder can be one of the most dangerous aspects related to working on the roof. When performing these maneuvers, a worker may potentially lose their balance, the ladder may shift, etc., causing the worker to slip and/or fall from the ladder or the roof structure. A worker falling from the roof and/or ladder may potentially be subjected to serious bodily injury and even death.

In this manner, prior art roof safety devices were developed to minimize the potential harm to workers while conducting work activities on the roof of a structure. Prior art roof safety devices typically are fixedly mounted on the apex of the roof structure, or alternatively, on the opposite side of the roof structure from the ladder, or other climbing means. Such prior art roof safety devices typically provide enough leverage to support a worker on the inclined surface of the roof.

Prior art roof safety devices are generally complex in design and require the worker to step onto the roof from the ladder, or other climbing means, to install the prior art roof safety device prior to utilizing the device in place. In this manner, the worker is required to step onto the roof surface without a prior art safety device. Additionally, the prior art roof safety device typically directly abuts at least one side of the roof apex and/or ridge vent potentially causing damage to the abutted side of the roof apex, the ridge vent, or both.

Therefore, a need exists in the art for an improved roof safety device that is simple in design and capable of being installed prior to a worker stepping onto the roof from the ladder or other climbing means, ensuring the worker's safety while moving from the ladder to the roof surface. Further, a need exists for a roof safety device that is easily adapted to roofs having different roof pitches while minimizing potential damage to the roof surface, the roof apex and/or ridge vent.

The roof safety device of the present invention overcomes these problems.

SUMMARY OF THE INVENTION

Objectives of the present invention include providing a roof safety device with a relatively simple design which is durable and that allows the worker to install and remove the roof safety device from the safety of a ladder, or other secured climbing means.

A further objective of the present invention is to provide a roof safety device that is easily adaptable to roof structures having different roof pitches without contacting the roof apex and/or ridge vent minimizing potential damage to the roof apex and/or ridge vent of the roof structure.

These objectives and advantages are obtained by a roof safety device comprising a fixed arm having a generally arched portion and a first cross-beam; a hook-slide slidably cooperating with said arched portion of said fixed arm, said hook-slide including a second cross-beam a means for removably locking said hook-slide into fixed engagement with said fixed arm; a harness connected to said fixed arm.

BRIEF DESCRIPTION OF THE SEVERAL VIEWS OF THE DRAWINGS

The preferred embodiment of the present invention, illustrative of the best mode in which Applicant has contemplated applying the principles, is set forth in the following description, is shown in the drawings, and is particularly and distinctly pointed out and set forth in the appended claims.

Similar numerals refer to similar parts throughout the drawings.

DESCRIPTION OF THE PREFERRED EMBODIMENT

In order to better understand the structure, assembly and operation of the preferred embodiment roof safety device of the present invention and its various configurations, the structure, assembly and operation of a typical prior art roof safety device will be described in detail below.

Figure 1:
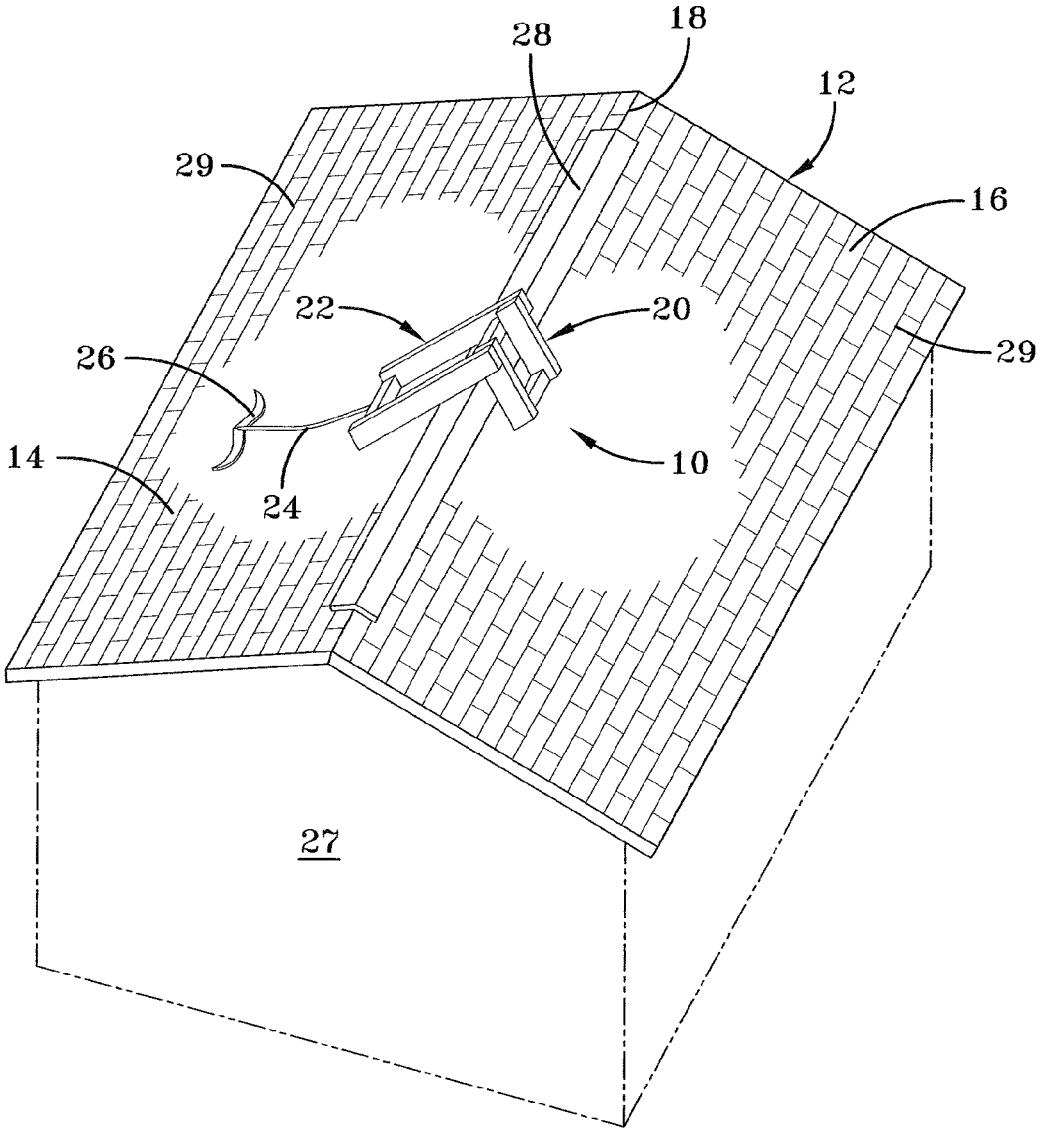
FIG-1 PRIOR ART
FIG. 1 is a perspective view of a prior art roof safety device positioned on a roof of a structure.
Figure 2:
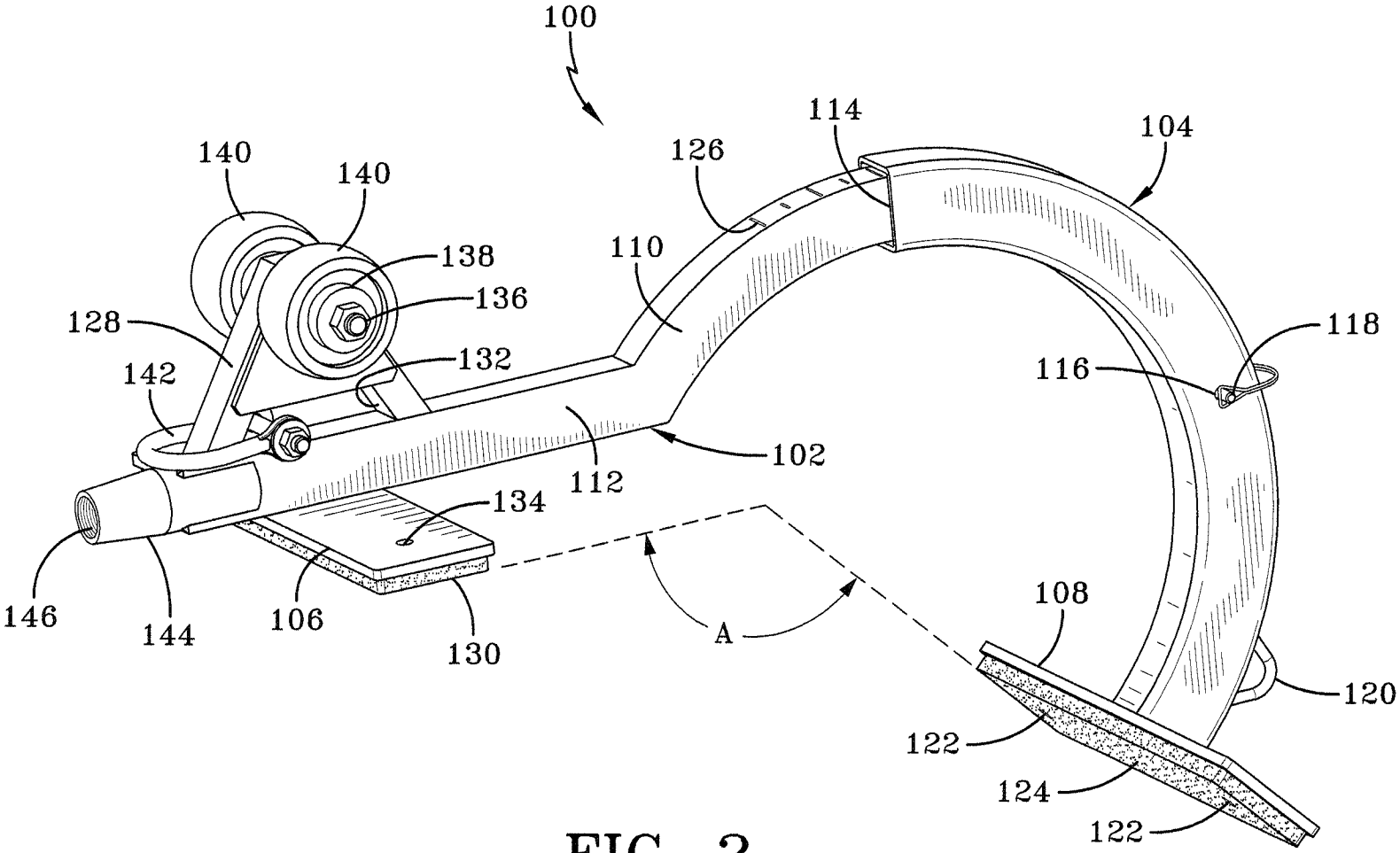
FIG. 2 is a perspective side view of a preferred embodiment roof safety device of the present invention, with the extension pole removed from the safety device.
Figure 3:
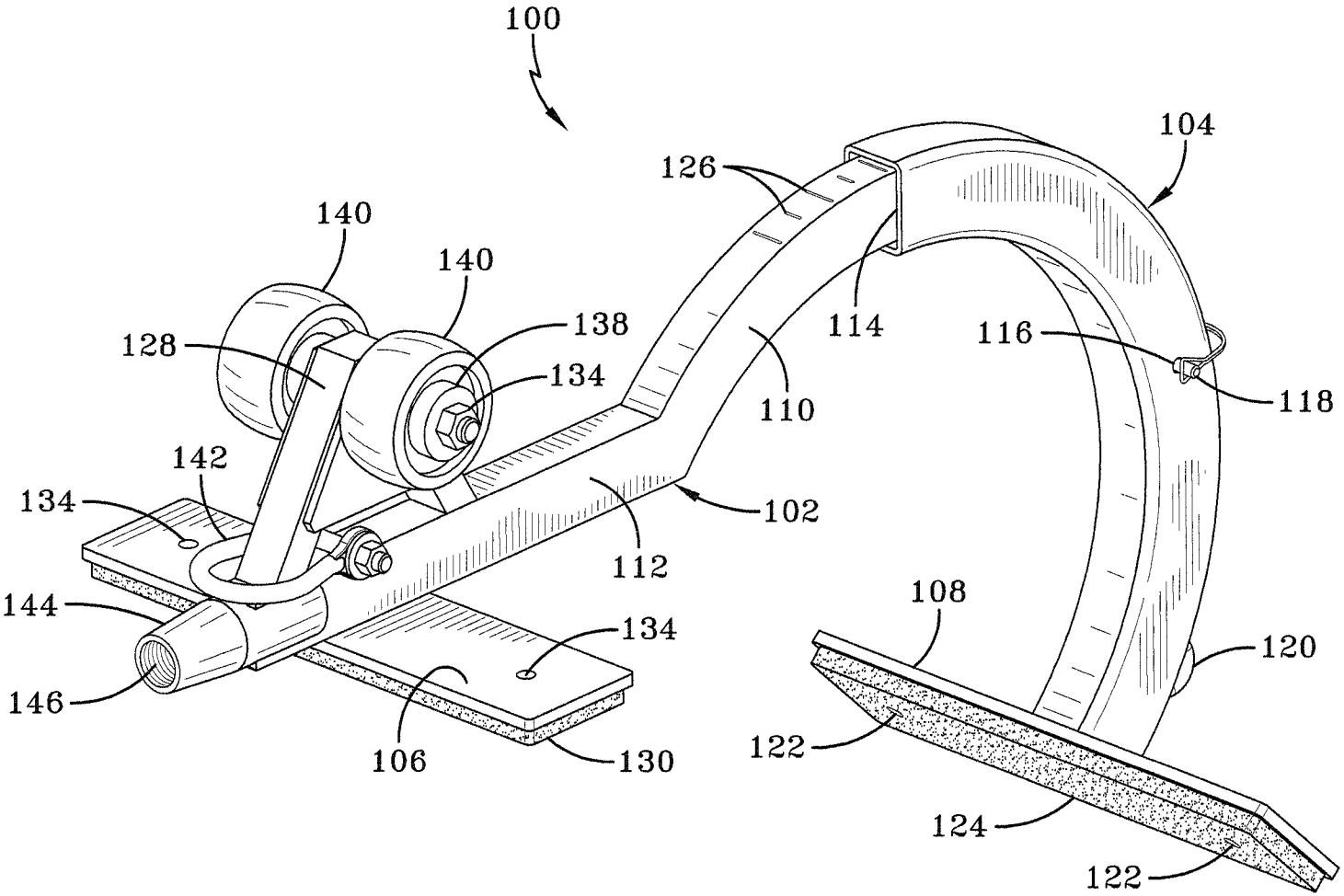
FIG. 3 is a perspective view of the preferred embodiment roof safety device shown in FIG. 2, showing the adjustable hook slide capable of adjusting to different roof pitches and showing the wheels and the harness clip of the roof safety device.

A prior art roof safety device 10 is shown in FIG. 1. Prior art roof safety device 10 is shown fully installed on a roof 12 of a structure 27 (not shown), as will be described. Roof 12 includes a pair of inclined members 14, 16 that form a roof apex 18. Inclined surfaces 14, 16 are generally covered with shingles 29, which are arranged and attached to the inclined members in a manner well know to those having skill in the art. It should be understood that alternative means for covering the roof structure exist such as metal sheeting and rubber sheeting as are generally well known in the art. A ridge vent 28 extends longitudinally along apex 18 of roof 12. Ridge vent 28 is mounted on inclined member 14,16 at apex 18 in a manner well known in the art. Ridge vent 28 includes openings (not shown) formed along the longitudinal sides of the ridge vent that provide air flow from the attic space below roof inclined members 14,16 to atmosphere. Ridge vent 28 is typically formed from plastic or aluminum or other similarly suitable material. Prior art roof safety device 10 generally includes an anchor portion 20, a stabilizer portion 22, a cord 24, and a harness 26. Anchor portion 20 and stabilizer portion 22 are arranged generally perpendicular to one another to provide leverage when in use to support a worker attached to harness 26.

The positioning of anchor portion 20 flat upon roof inclined member 16 may damage shingles 29 on the roof member, and/or ridge vent 28, More specifically, because anchor portion 20 of prior art roof safety device 10 rests flat on ridge vent 28 and shingles 29 attached to roof inclined member 16, the safety device can potentially cause damage to the ridge vents and/or the shingles or other roof covering. Additionally, a worker must step off of a ladder, or other climbing means (not shown), and climb the pitched or slanted roof member 14 to install prior art roof safety device 10 upon roof 12. In this manner, the worker must climb from the ladder to roof 12 and maneuver across the roof without being attached to roof safety device 10 or any other restraining means, increasing the potential for injury and/or slipping from the roof 12 of the building.

Likewise, a worker removing prior art safety device 10 will be required to move from roof apex 18 where the roof safety device is anchored back to the ladder, and from the roof onto the ladder, without any form of restraint (safety) to prohibit the worker from falling from the roof of the structure.

Therefore, a need exists in the art for an improved roof safety device that is simple in design, durable, and minimizes and/or eliminates potential damage to the ridge vent and/or roof. Additionally, a need exists for an improved roof safety device that is capable of being installed and uninstalled while the worker remains on the secured ladder minimizing the potential for slipping and/or falling from the roof, ladder, or other climbing means. The roof safety device of the present invention accomplishes these needs. The structure and installation of the roof safety device of the present invention will now be described in detail below.

Turning now to FIGS. 2-5, a preferred embodiment roof safety device of the present invention is indicated generally at reference number 100. Preferred embodiment roof safety device 100 of the present invention generally includes a fixed arm 102, a hook slide 104, and a pair of crossbeams 106, 108. Fixed arm 102 includes an arched or curved portion 110, a straight portion 112, and a harness support portion 128. Hook slide 104 has a generally arched or curved shaped and is formed with an opening 114 to accept curved portion 110 of fixed arm 102. Additionally, hook slide 104 is formed with an opening 116 at about its midpoint to accept a hitch pin 118. Hitch pin 118 is disposed through a corresponding opening (not shown) in curved portion 110 of fixed arm 102 to secure hook slide 104 to the fixed arm forming a generally U-shaped, arched structure that anchors about the apex of the roof of a structure, as will be described below.

Figure 4:
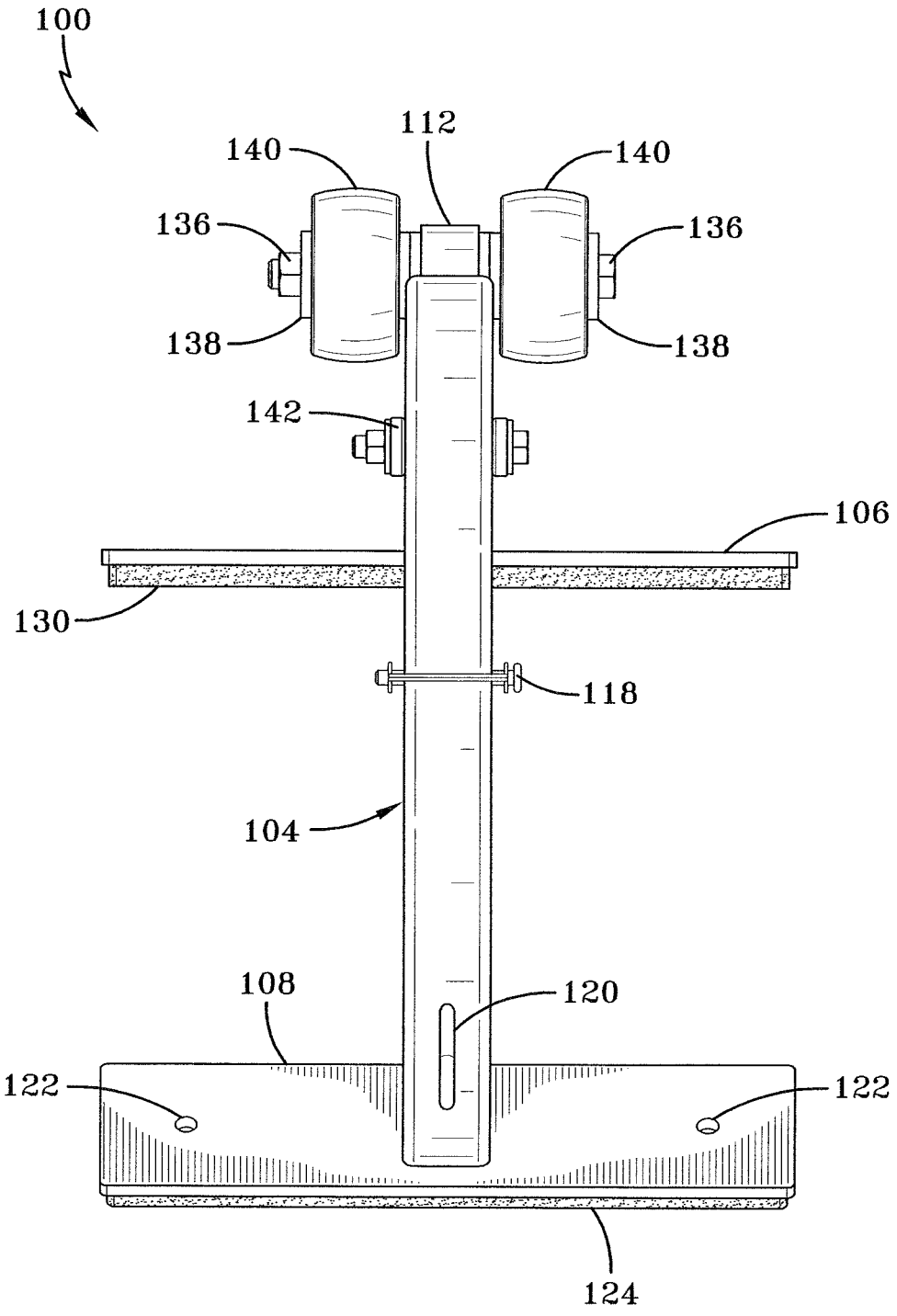
FIG. 4 is a perspective rear view of the preferred embodiment roof safety device shown in FIG. 2, showing the secondary harness eyelet of the roof safety device.

Hook slide 104 further includes a secondary harness eyelet 120 protruding near the distal end of the hook slide. The distal end of hook slide 104 is rigidly connected to cross beam 108, preferably by welding, and the cross beam extends generally perpendicular to the hook slide. Cross beam 108 is a generally flat rectangular shape and is formed with a pair of openings 122 (FIG. 4). A compressible pad 124 is attached to the bottom surface of cross beam 108. Compressible pad 124 is preferably formed from a foam material to minimize impacts to the roof and also to promote additional contact friction between cross beam 108 and the upper surface of roof 12.

Curved portion 110 of fixed arm 102 includes markings 126 that provide indications to the user of roof safety device 100, for adjusting the roof safety device to the slope or pitch of roof apex 18. More particularly, each marking 126 corresponds to an opening (not shown) formed in curved portion 110 that accepts hitch pin 118 of hook slide 104. In this manner, each marking 126 corresponds to an angle A that may be adjusted to correspond to and accommodate roof apex 18 and/or ridge vent 28 of roof 12 by sliding fixed arm 102 into and out of hook slide 104. Additionally, straight portion 112 of fixed arm 102 is rigidly connected to cross beam 106, preferably by welding. Cross beam 106, like cross beam 108, is a generally flat rectangular plate that is formed with a pair of openings 134. A compressible pad 130 is attached to the bottom surface of cross beam 106. Compressible pad 130 is preferably formed from a foam material to minimize impacts to the roof and also to promote additional friction between cross beam 108 and the upper surface of the roof Harness support portion 128 of fixed arm 102 is generally triangular in shape and includes an opening 132 formed between straight portion 112 and the harness support portion. A removable harness clip 142 is connected to harness support portion 128 to provide a location for the worker to attach a safety line 150 thereto. Harness support portion 128 further includes a wheel opening (not shown) that accepts a fastener 136, preferably a bolt, with a corresponding washer 138 and a nut (not shown) to removably attach a pair of wheels 140 to the harness support portion. Wheels 140 are preferably formed of rubber or other similar material.

Opposite from cross beam 108, a coupler end 144 of straight portion 112 is formed with a threaded coupler opening 146. A pole 152 is connected to preferred embodiment roof safety device 100 by screwing a threaded end of the pole (not shown) into threaded coupler opening 146 of coupler end 144 to attach the pole to roof safety device 100. In this manner, preferred embodiment roof safety device 100 of the present invention may be assembled by the worker prior to climbing a ladder 156, or other secured climbing means, minimizing the potential for injury, as will be described below. Other connections of pole 152 to coupler end 144 of straight portion 112 of roof safety device 100 could also be utilized, such as a pole that is slip fit onto the coupler end and held in place with a connecting pin, or other known means of securement, without changing the overall concept or operation of the present invention.

Figure 5:
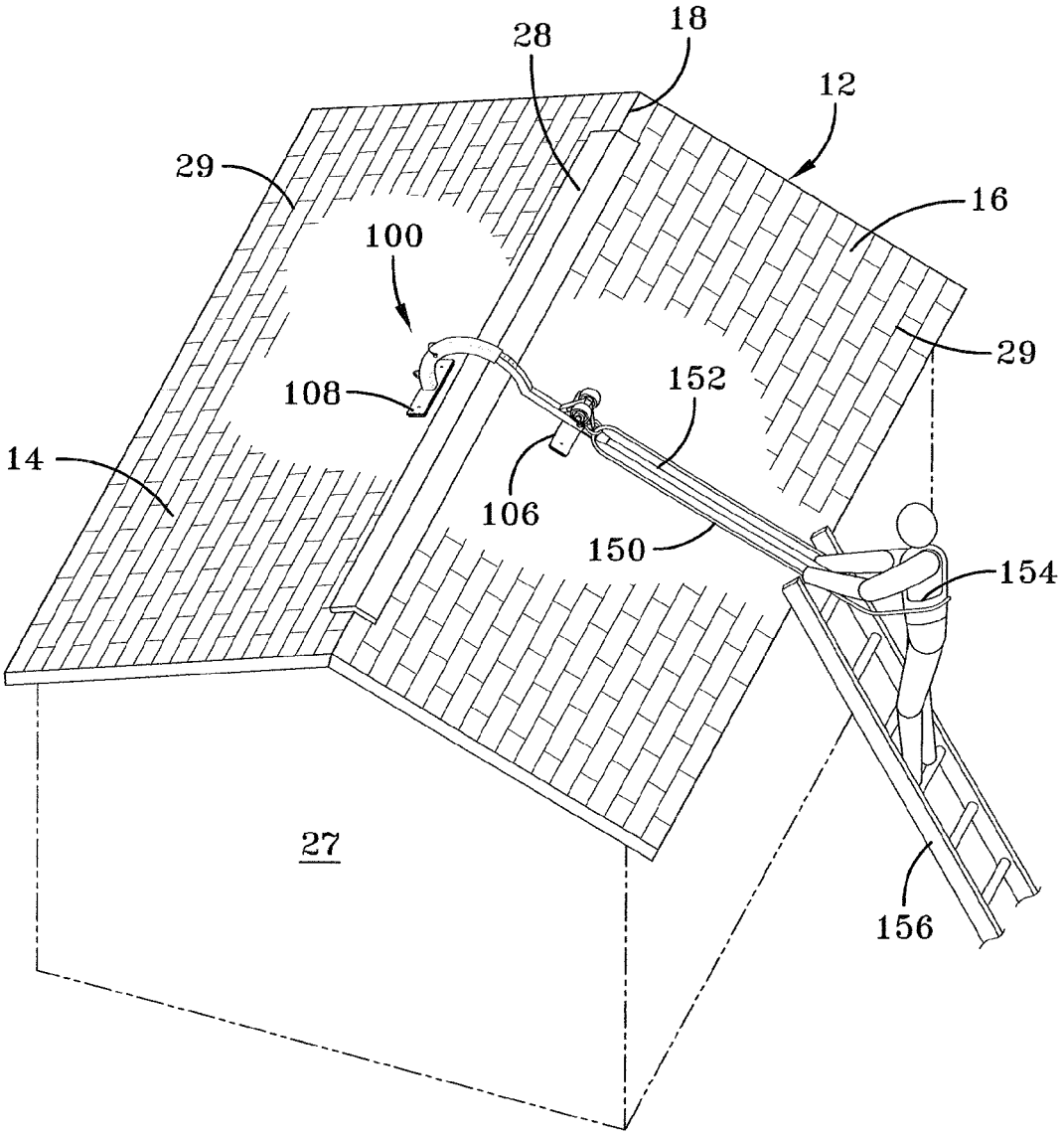
FIG. 5 is a perspective view of the preferred embodiment roof safety device following installation on a roof, with the extension pole attached to the roof safety device.

Turning now to FIG. 5, now that the structure of preferred embodiment roof safety device 100 of the present invention has been described, the installation and operation of the roof safety device will be described in detail below. Prior to ascending ladder 156, or other climbing means, the worker, or user of roof safety device 100, adjusts angle A to account for the roof pitch of the structure he/she is about to perform work on, by sliding fixed arm 102 into and out of hook slide 104. More specifically, the worker uses markings 126 to adjust roof safety device 100 to correspond to the pitch of roof apex 18 to ensure optimal placement of the roof safety device and to minimize potential damage to the roof apex and/or ridge vent 28 of roof 12. Upon determining the marking 126 that corresponds to the pitch of roof apex 18, hitch pin 118 is inserted through opening 116 and the corresponding opening (not shown) in curved portion 110 of fixed arm 102. In this manner, angle A generally corresponds to the slope or pitch of roof apex 18 ensuring optimal placement of the roof safety device 100 and minimizing potential damage of roof 12 and/or the ridge vent of the roof by the roof safety device.

After proper adjustment of angle A of roof safety device 100, worker attaches their harness 154 to either harness clip 142 or harness eyelet 120. User then connects pole 152, as described above, to preferred embodiment roof safety device 100 of the present invention prior to the user stepping onto ladder 156, or other climbing means. Once roof safety device 100 is configured to the proper adjustment angle and assembled, the user then delivers the roof safety device to roof 12 by ascending ladder 156. Roof safety device 100 of the present invention is oriented by the worker in such a way on roof 12 so that the wheels 140 are in contact with roof 12 and pads 124, 130 are facing generally away from the roof. Roof safety device 100 of the present invention is wheeled or maneuvered across roof 12 by the worker utilizing pole 152 so that curved portion 110 and hook slide 104 are positioned over roof apex 18 and/or ridge vent. Once positioned, preferred embodiment roof safety device 100 is rotated about 180 degrees utilizing pole 152 such that pads 124,130 of crossbeams 106, 108, respectively, contact roof 12. In this manner, curved portion 110 and hook slide 104 straddle roof apex 18 and/or ridge vent 28 of roof 12. Pads 124, 130 of crossbeams 106, 108, respectively, minimize potential damage to roof 12, while providing traction or contact friction to roof safety device 100, thereby resulting in optimal, secure installation of the roof safety device on the roof. Additionally, if roof 12 is unfinished, fasteners (not shown) may be disposed through openings 122, 134 of cross beams 106,108, respectively, and fixed to the roof to further secure preferred embodiment roof safety device 100 to the roof.

Once preferred embodiment roof safety device 100 is positioned over roof apex 18 and/or the ridge vent, the user may safely disembark from ladder 156. In this manner, worker is able to safely exit ladder 156 onto roof 12, while minimizing the potential risk of slipping and/or falling from the roof, as a result of being safely harnessed to preferred embodiment roof safety device 100.

Once the worker is on roof 12, preferred embodiment roof safety device 100 of the present invention maintains the safety of the worker. For example, if the worker slips on roof 12 and slides towards the edge of the roof, safety harness 154 connected to roof safety device 100 of the present invention, will minimize the potential consequences of the fall. More specifically, harness 154 is connected to harness clip 142 or harness eyelet 120 of roof safety device 100 of the present invention. In this manner, once line 150 of the safety harness 154 tightens, the line pulls the harness clip 142 or harness eyelet 120. Roof safety device 100 of the present invention remains fixed atop roof apex 18 of the roof as a result of the leverage created by crossbeam 106, 108 as well as the additional friction created from the contact of pads 124,130 with roof 12, thereby minimizing movement of the roof safety device and stabilizing the worker who slipped and fell. In this manner, the potential consequences of the user falling from roof 12 are minimized.

Upon completion of the task on roof 12, the worker maneuvers towards ladder 156, or other climbing means, and exits the roof onto the ladder. In this manner, the user is safely harnessed to roof safety device 100 upon exiting roof 12, thereby preventing a potential slip and/or potential fall from roof 12. Roof safety device 100 is then oriented onto wheels 140 such that the wheels are in contact with the surface of roof 12 and pads 124, 130 are facing generally away from the roof. The roof safety device is wheeled or maneuvered by the worker utilizing pole 152 towards ladder 156 from roof apex 18 and/or the ridge vent of the roof. Once back to the ladder, roof safety device 100 can be removed from roof 12 and lowered to the ground by the worker.

Roof safety device 100 of the present invention is lighter than typical prior art roof safety device 10 and may be installed about roof apex 18 and/or ridge vent 28 of roof 12 minimizing potential damage to the ridge vent or roof covering of the roof. Additionally, roof safety device 100 of the present invention is installed, and uninstalled, while the worker remains on ladder 156 minimizing the potential for slipping and/or falling from the ladder or structure.

It is contemplated that shapes of curved portion 110 of fixed arm 102 and hook slide 104, other than generally U-shaped, may be utilized without changing the overall concept or operation of the present invention. It is also contemplated that additional harness clip 142 and/or harness eyelet 120 may be utilized without changing the overall concept or operation of the present invention. It is even further contemplated that harness support portion 128 may include other shapes, other than triangular, without changing the overall concept or operation of the present invention. It is contemplated that additional cross beams 106, 108 may be utilized without changing the overall concept or operation of the present invention. It is contemplated that other securing means, other than hitch pin 118, may be utilized without changing the overall concept or operation of the present invention. It is also contemplated that a single wheel 140 or a plurality of wheels may be utilized without changing the overall concept or operation of the present invention. It is even further contemplated that a single opening 134, 122 or a plurality of openings 134, 122 may be utilized without changing the overall concept or operation of the present invention. It is contemplated that other materials may be used for friction pads 124, 130 without changing the overall concept or operation of the present invention. It is also contemplated that pole 152 may be a fixed length or telescoping without changing the overall concept or operation of the present invention.

Accordingly, the roof safety device of the present invention is simplified, provides an effective, safe, inexpensive and efficient structure and method which achieves all the enumerated objectives, provides for eliminating difficulties encountered with prior roof safety devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the roof safety device of the present invention is used and installed, the characteristics of the construction, arrangement and method steps, and the advantageous, new and useful results obtained; the new and useful structures, devices, elements, arrangements, process, parts and combinations are set forth in the appended claims.

What is claimed is:

1. A roof safety device comprising:

a fixed arm having a generally curved arched portion and a first cross-beam;

a hook-slide having a generally curved arched portion complimentary shaped to said fixed arm curved arched portion, the fixed arm curved arched portion and said hook-slide curved arched portion slidably engaging each other to selectively adjust an angle between the fixed arm and the hook-slide, said hook-slide including a cross-beam;

a means for removably locking said hook-slide into fixed engagement with said fixed arm;

a primary harness eyelet formed in said fixed arm directly above said first crossbeam;

a harness connected to said primary harness eyelet, said harness being capable of supporting a worker;

a pole removably connected to said fixed arm; and a wheel mounted on said fixed arm; whereby said roof safety device is capable of being placed onto a roof apex of a building utilizing said pole prior to climbing onto said roof, wherein said wheel mounted on said fixed arm further comprises said wheel mounted on a harness support portion formed on said fixed arm, and said primary harness eyelet mounted on said harness support portion, said harness support portion extending away from said cross-beam.

2. The roof safety device of claim 1, wherein said fixed arm cross-beam and said hook-slide cross-beam each further include a compressible pad.

3. The roof safety device of claim 2, wherein said compressible pad is formed from rubber.

4. The roof safety device of claim 1, wherein said removable connection of said pole to said fixed arm is a threaded connection.

5. The roof safety device of claim 1, wherein said wheel is formed from rubber.

6. The roof safety device of claim 1, wherein said means for removeably locking said hook-slide into fixed engagement with said fixed arm comprises a hitch pin extending through a pair of aligned openings formed in said hook-slide and said fixed arm.

7. The roof safety device of claim 1, further comprising markings located on said fixed arm that correspond to particular pitches for a roof so that as the hook-slide slideably engages with the fixed arm, the roof safety device accommodates selected roof pitches.

8. The roof safety device of claim 1, further comprising a secondary harness eyelet formed in said hook-slide for connecting a secondary harness to the hook-slide of the roof safety device.

9. The roof safety device of claim 1, said fixed arm and hook-slide cross-beams each being generally flat rectangular plates and are each arranged generally perpendicular to said fixed arm and said hook-slide, respectively.

10. The roof safety device of claim 1, said fixed arm and hook-slide cross-beams each being formed with at least one opening extending through said cross-beam.

* * * * *